US006478715B1

(12) United States Patent
Hunold

(10) Patent No.: US 6,478,715 B1
(45) Date of Patent: Nov. 12, 2002

(54) METHOD FOR CONTROLLING A POWER-SHIFT MULTI-SPEED BOAT TRANSMISSION

(75) Inventor: Bernard Hunold, Friedrichshafen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 09/763,488

(22) PCT Filed: Aug. 28, 1999

(86) PCT No.: PCT/EP99/06355

§ 371 (c)(1),
(2), (4) Date: Feb. 22, 2001

(87) PCT Pub. No.: WO01/13969

PCT Pub. Date: Mar. 16, 2000

(30) Foreign Application Priority Data

Sep. 3, 1998 (DE) ..... 198 40 082

(51) Int. Cl.[7] ..... B60K 41/04

(52) U.S. Cl. ..... 477/115; 477/120; 701/55; 701/56; 440/38; 440/75

(58) Field of Search ..... 477/115, 120; 701/55, 56; 440/38, 75

(56) References Cited

U.S. PATENT DOCUMENTS

| | | | | | |
|---|---|---|---|---|---|
| 4,637,802 | A | * | 1/1987 | Taguchi et al. | 192/48.91 |
| 4,945,484 | A | * | 7/1990 | Cote et al. | 477/125 |
| 4,947,331 | A | * | 8/1990 | Speranza | 477/120 |
| 5,050,461 | A | * | 9/1991 | Onoue et al. | 440/86 |
| 5,053,963 | A | * | 10/1991 | Mack | 180/170 |
| 5,089,962 | A | * | 2/1992 | Steeby | 477/120 |
| 5,127,858 | A | * | 7/1992 | Pelligrino et al. | 440/2 |
| 5,233,525 | A | * | 8/1993 | Overmann et al. | 477/123 |
| 5,242,320 | A | * | 9/1993 | Schmidt et al. | 440/86 |
| 5,706,783 | A | * | 1/1998 | Sawada | 123/406.47 |
| 5,711,742 | A | * | 1/1998 | Leinonen et al. | 440/75 |
| 5,730,682 | A | | 3/1998 | Depping et al. | 477/120 |
| 5,741,165 | A | * | 4/1998 | Saito et al. | 248/641 |
| 5,778,329 | A | * | 7/1998 | Officer et al. | 123/564 |
| 5,827,150 | A | * | 10/1998 | Mukumoto | 123/331 |
| 5,904,068 | A | * | 5/1999 | Genise | 477/111 |
| 6,022,292 | A | * | 2/2000 | Goodnight | 477/115 |
| 6,042,502 | A | * | 3/2000 | Cronin et al. | 477/120 |
| 6,098,591 | A | * | 8/2000 | Iwata | 123/339.11 |
| 6,102,755 | A | * | 8/2000 | Hoshiba | 440/1 |
| 6,188,943 | B1 | * | 2/2001 | Uchida et al. | 192/3.54 |

FOREIGN PATENT DOCUMENTS

| | | |
|---|---|---|
| DE | 1 949 938 | 11/1970 |
| DE | 35 39 684 A1 | 5/1986 |
| DE | 36 08 790 A1 | 9/1987 |
| DE | 196 24 913 A1 | 1/1997 |
| DE | 197 42 815 A1 | 4/1998 |

OTHER PUBLICATIONS

"Three Speed Gear For Offshore Racers", *Marine Propulsion*, Sep./Oct. 1991, p. 28.

* cited by examiner

*Primary Examiner*—Rodney H Bonck
*Assistant Examiner*—David D. Le
(74) *Attorney, Agent, or Firm*—Davis & Bujold, P.L.L.C.

(57) ABSTRACT

According to the method for controlling at least one power-shift multi-speed boat transmission in conjunction with a fixed propeller or water jet, the upshift speed is a function of a value which indicates the intended acceleration, especially a function of the regulating speed of the control lever or the speed of modification of the transmission input speed.

30 Claims, 1 Drawing Sheet

METHOD FOR CONTROLLING A POWER-SHIFT MULTI-SPEED BOAT TRANSMISSION

FIELD OF THE INVENTION

The invention concerns a method for controlling a power-shift, multi-speed boat transmission.

BACKGROUND OF THE INVENTION

Multi-speed boat transmission, combined with a fixed propeller or water jet, are know already. Such transmissions allow a variable adaptation of the motor to different operating conditions whereby the motor can always work at the optimum rotational speed range.

DE 196 24 913 A1 discloses a marine transmission system having one motor, one shifting mechanism and one programmable electronic control device with a shift parameter matrix. The electronic control device monitors the motor load and the rate of revolutions and produces a control signal which controls the shifting operations.

DE 19 49 938 has made known a shifting automatic system for a boat transmission system having one-step or multi-step transmissions wherein a first control loop adjusts, via the torque of the boat propeller, the output rotational speed of the transmission required by the driving conditions that occur and a second control loop controls the rotational speed of the motor and the output of the motor in accordance with the first control loop.

The above cited prior art requires coordination of the transmission with the electronic system of the motor. Consequently, it is not possible to combine different types of transmission with different motors without high expenditure in adaptation and costs.

SUMMARY OF THE INVENTION

The invention is based on the problem of making available a method for control of a power-shift, multi-speed transmission which automatically permits a variable adaptation to different operating conditions without requiring a coordination of the transmission with the electronic system of the motor.

Thereby the inventive method can be universally utilizable.

In addition, the change of gear must occur without traction interruption. This is of great importance, particularly in fast boats, in order that during the gearshift operation the boat does not fall off the plane with its low resistance to the motion.

Accordingly, it is proposed to deduce the intended acceleration from the movement of the control lever or from the change of the input rotational speed of the transmission and thus to introduce a shifting operation at different rotational speeds of the motor.

Consequently, a quick movement of the control lever or a quick upshift of the motor is interpreted as a desire for high acceleration for the boat and the shift point in the higher gear is moved toward high motor rotational speeds. In such a case, the rotational speed of the motor at the shift point can amount to 95% of the nominal rotational speed and preferably be in the interval between 80% and 100% of the nominal rotational speed.

On the other hand, a slow movement of the control lever or a slow upshift of the motor is interpreted as a desire for a more moderate acceleration of the boat and the shift point in the high gear is moved toward low rotational speeds of the motor. A typical value of the rotational speed of the motor at the shift point is 75% of the nominal rotational speed. Other values for the rotational speed of the motor at the shift point can be in the interval between 60% and 80% of the nominal rotational speed value.

According to the invention, the upshift is introduced only when the forward gear is engaged. For reasons of safety, the quick gear cannot be engaged in reverse motion.

According to the invention, the possibility of a kick-down downshift is provided for when it should be accelerated at a rotational speed range above the rotational speed of the downshift.

In boats equipped with a multi-engine installation, the shifting operation occurs simultaneously in all transmissions as soon as a transmission meets the shifting criterion.

The rotational speed of the motor can be optionally lowered during the gear shift.

This described method also provides for the possibility of a manual gear shift. However, to prevent damage to the power transmission due to operating error, the rotational speed range for manual gear shift is limited, a typical value of the nominal rotational speed being 45% here. At high rotational speeds of the motor, the introduced gear position is blocked.

The inventive control method has the advantage that an expensive coordination with the electronic system of the motor is not required. Thus, several types of transmissions can be combined with several motors.

BRIEF DESCRIPTION OF THE DRAWINGS

The invention is explained in detail herebelow with reference to a single FIGURE which shows a diagram illustrating the interrelation between the regulating speed of the control lever and the upshift rotational speed, the same as the downshift rotational speed of the motor, within the scope of the inventive method.

DESCRIPTION OF THE PREFERRED EMBODIMENTS

Figure 1:
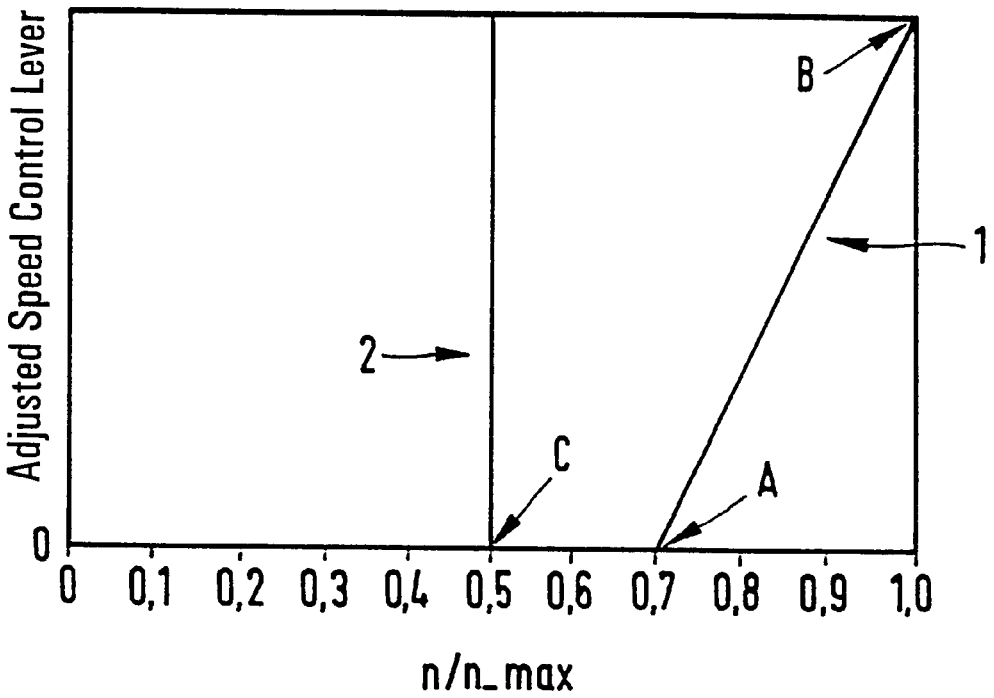

Although, as shown here, the interrelation is linear, it is also possible according to the invention to take as basis another interrelation of the two variable regulating speed and upshift rotational speed. Other values can also be implemented for introducing the shifting operations.

Consequently, when the boat speed is returned the high gear remains engaged until this downshift rotational speed; only when falling below the rotational speed is the lower gear down changed.

The interrelation between modification of speed of the transmission input rotational speed and the upshift rotational speed can also be illustrated with reference to this diagram, since a direct interrelation exists between the modification of the rotational speed of the transmission and the regulating speed of the control lever: the quicker the control lever is moved, the quicker the rotational speed of the motor is increased.

What is claimed is:

1. A method for control of at least one power-shift, multi-speed boat transmission combined with a fixed propeller or water jet having a control lever for regulating a rotational speed of the transmission, the method comprising the step of controlling the rotational speed at which an upshift of the transmission occurs as a direct function of a regulating speed of the control lever.

2. The method according to claim 1, further comprising the step of moving the transmission into a high gear toward a high rotational speed of a motor when a high regulating speed of the control lever is interpreted as a demand for a highest acceleration of the boat.

3. The method according to claim 2, further comprising the step of using an interval of between 80% and 100% of a nominal rotational speed as a shift point rotational speed of the motor.

4. The method according to claim 1, further comprising the step of moving the shift point in the high gear toward a low rotational speed of the motor when a low regulating speed of the control lever is interpreted as a demand for a moderate speed of the boat.

5. The method according to claim 4, further comprising the step of using an interval of between 60% and 80% of a nominal rotational speed as a shift point rotational speed of the motor.

6. The method according to claim 1, further comprising the step of allowing an upshifting only when a forward gear is engaged.

7. The method according to claim 1, further comprising the step of preventing upshifting when in a reverse drive.

8. The method according to claim 1, further comprising the step of engaging a low gear when the control of the transmission fails.

9. The method according to claim 1, further comprising the step of maintaining a high gear until the rotational speed of the motor falls below a downshift rotational speed and then automatically downshifting the transmission.

10. The method according to claim 9, further comprising the step of providing a downshift rotational speed interval of between 35% and 70% of a nominal rotational speed of the motor.

11. The method according to claim 1, further comprising the step of providing for a kick-down downshift when acceleration is to be effected in a rotational speed range above the downshift rotational speed.

12. The method according to claim 1, further comprising the step of providing a boat with a plurality of power-shift, multi-speed boat transmission with each transmission driving a fixed propeller or water jet, and operating gearshifts simultaneously as soon as one of the transmissions meets a shifting criterion.

13. The method according to claim 1, further comprising the step of lowering, during the shifting operation, the rotational speed of the motor.

14. The method according to claim 1, further comprising the step of providing a manual gearshift in which, in order to avoid damage to the transmission due to operator error, the rotational speed range for manual gearshifting is limited.

15. The method according to claim 14, further comprising the step of limiting the rotational speed range for manual gearshifting to a value between 35% and 60% of a nominal rotational speed.

16. A method for control of at least one power-shift, multi-speed boat transmission combined with a fixed propeller or water jet having a control lever for regulating a rotational speed of the transmission, the method comprising the step of controlling the rotational speed at which an upshift of the transmission occurs as a function of a gradient of a transmission input rotational speed.

17. The method according to claim 16, further comprising the step of moving the transmission into a high gear toward a high rotational speed of a motor when a quick increase of a transmission input rotational speed is interpreted as a demand for a highest acceleration of the boat.

18. The method according to claim 17, further comprising the step of using an interval of between 80% and 100% of a nominal rotational speed as a shift point rotational speed of the motor.

19. The method according to claim 16, further comprising the step of moving the shift point in the high gear toward a low rotational speed of the motor when a slow increase of the rotational speed of the transmission is interpreted as a demand for a moderate speed of the boat.

20. The method according to claim 19, further comprising the step of using an interval of between 60% and 80% of a nominal rotational speed as a shift point rotational speed of the motor.

21. The method according to claim 16, further comprising the step of allowing an upshifting only when a forward gear is engaged.

22. The method according to claim 16, further comprising the step of preventing upshifting when in a reverse drive.

23. The method according to claim 16, further comprising the step of engaging a low gear when the control of the transmission fails.

24. The method according to claim 16, further comprising the step of maintaining a high gear until the rotational speed of the motor falls below a downshift rotational speed and then automatically downshifting the transmission.

25. The method according to claim 24, further comprising the step of providing a downshift rotational speed interval of between 35% and 70% of a nominal rotational speed of the motor.

26. The method according to claim 16, further comprising the step of providing for a kick-down downshift when acceleration is to be effected in a rotational speed range above the downshift rotational speed.

27. The method according to claim 16, further comprising the step of providing a boat with a plurality of power-shift, multi-speed boat transmission with each transmission driving a fixed propeller or water jet, and operating gearshifts simultaneously as soon as one of the transmissions meets a shifting criterion.

28. The method according to claim 16, further comprising the step of lowering, during the shifting operation, the rotational speed of the motor.

29. The method according to claim 16, further comprising the step of providing a manual gearshift in which, in order to avoid damage to the transmission due to operator error, the rotational speed range for manual gearshift is limited.

30. The method according to claim 29, further comprising the step of limiting the rotational speed range for manual gearshift to a value between 35% and 60% of a nominal rotational speed.

* * * * *